US006988457B2

(12) United States Patent
Tsai

(10) Patent No.: US 6,988,457 B2
(45) Date of Patent: Jan. 24, 2006

(54) STRUCTURE FOR FASTENING SHIPBOARD-PROTECTING FENDER

(76) Inventor: Cheng Fung Tsai, 11th Fl., No. 168, Sung Chiang Road, Taipei (TW)

( * ) Notice: Subject to any disclaimer, the term of this patent is extended or adjusted under 35 U.S.C. 154(b) by 0 days.

(21) Appl. No.: 10/828,886

(22) Filed: Apr. 21, 2004

(65) Prior Publication Data

US 2005/0235896 A1 Oct. 27, 2005

(51) Int. Cl.
*B63B 59/02* (2006.01)

(52) U.S. Cl. ..... 114/219; 405/212

(58) Field of Classification Search ..... 114/219, 114/364; 293/120, 126, 142; 405/212, 215
See application file for complete search history.

(56) References Cited

U.S. PATENT DOCUMENTS 938,645 A * 11/1909 Davis ..... 114/219
2,959,146 A * 11/1960 Erkert ..... 114/219
3,338,206 A * 8/1967 Motter ..... 114/219
4,548,150 A * 10/1985 Drewett ..... 114/219
4,854,258 A * 8/1989 Hausmann et al. ..... 114/219
5,658,633 A * 8/1997 Di Biase ..... 428/68

* cited by examiner

*Primary Examiner*—Andrew D. Wright
(74) *Attorney, Agent, or Firm*—Bucknam and Archer; Joseph J. Orlando

(57) ABSTRACT

There is disclosed a structure for fastening a shipboard-protecting fender comprising: a plurality of reinforcing rib layers securely provided on the inner and outer faces of a shipboard; a fixed base horizontally fastened on the reinforcing rib layers of the shipboard by means of a plurality of bolts, an accommodating space being formed at the outside of the fixed base; a core layer, one end of which is accommodated in the accommodating space of the fixed base; a bump-preventing layer covering the outer surface of the core layer and the fixed base; a pair of fixed plates supported at the outside of the two ends of the bump-preventing layer; and a plurality of bolts vertically passing through the fixed plates, the bump-preventing layer, the fixed base, and the core layer for fastening them, in which the bump-preventing layer is made from polyurethane (P. U.) material, while the core layer is made from the close cell of ethylene-vinylacetate copolymer (E. V. A) material, whereby the shipboard-protecting fender thus constructed may be especially suitable for the light weight requirement for fast ships, owing to features including not only wear resistance, light weight, but also durable firmness.

10 Claims, 3 Drawing Sheets

STRUCTURE FOR FASTENING SHIPBOARD-PROTECTING FENDER

FIELD OF THE INVENTION

The present invention relates to a structure for fastening a shipboard-protecting fender, particularly to a ship-protecting fender with wear resistance, light weight, and durable firmness constructed by the enclosure of polyurethane (P. U.) material over the peripheral surface of a central core layer of the close cell of ethylene-vinylacetate copolymer (E. V. A) material, especially suitable for the light weight requirement for fast ships.

BACKGROUND OF THE INVENTION

Accordingly, traditional ships may heave with the tide, so as to waver permanently. As such, larger or small bumps frequently occur, provided that ships approach one with another, or the shore. For avoiding the damage to the hull owing to the bump, a shipboard-protecting fender surrounding the perimeter of the shipboard is designed; and/or waste tires may be hanged around the periphery of the hull as a whole directly in most fishing boats, for example, such that the effect of cushioning the impact force may be developed.

The conventional technology shown in FIGS. 1*a* and 1*b* is disclosed in Taiwan Utility Model Patent No. 389218, entitled "ASSEMBLED BUMP FENDER FOR SHIPS", comprising a continuous block (20') constituted by three to five rubber-made buffer units (13'), vertically through buffer holes (11') and fixing holes (12') which, spaced one with another, are formed inside each of the buffer units (13'), and buffer spaces (14'), each formed between any two of the adjacent buffer units (13'). The buffer effect may be developed by the buffer units (13'), the buffer holes (11'), and the buffer spaces (14'), if several blocks (20') are securely provided around the perimeter of the ship. In the above publication, there is disclosed a bump fender with rectangular cross section securely provided on the shipboard in a vertical direction by means of threaded fixtures. The bump fender is made from rubber, however, for achieving sufficient hardness required for resisting the impact, such that this bump fender should be extremely heavy resulting in unsuitable for fast ships. Moreover, the most protruding corner is liable to be created in this type of surface of the bump fender, such that the impact force may be born at a single point, rather than uniformly dispersed over an arc surface. Thus, it is liable to damage the bump fender in part resulting in a poor firmness and durability.

SUMMARY OF THE INVENTION

In view of the fact that there is still room to be improved in the traditional or conventional shipboard-protecting fender, it is the primary object of the present invention to provide a structure for fastening shipboard-protecting fender with light weight, wear resistance, impact resistance, superior resistance to stress damage, and durable firmness.

For achieving the aforementioned object, a structure for fastening shipboard-protecting fender is provided, comprising a plurality of reinforcing rib layers securely provided on the inner face and the outer face of the shipboard; a fixed base horizontally fastened on the reinforcing rib layer of the shipboard by means of a plurality of bolts, an accommodating space being formed at the outside of the fixed base; a core layer, one end of which is accommodated in the accommodating space of the fixed base; a bump-preventing layer covering the outer surface of the core layer and fixed base; a pair of fixed plates supported at the outside of the two ends of the bump-preventing layer; a plurality of bolts vertically passing through the fixed plates, the bump-preventing layer, the fixed base, and the core layer for fastening them.

According to the present invention, the bump-preventing layer on the surface of the shipboard-protecting fender is made from polyurethane material, featuring excellent wear resistance; the central core layer is the close cell of ethylene-vinylacetate copolymer material, physically featuring non-water absorbability, light weight, and excellent elasticity. Combining these two features, the characteristics of impact resistance and stress damage-resistance are established, and superior weather resistance, impermeability for water, and corrosion resistance are also included. Additionally, the bump-preventing layer with wear resistance is filled with the aforementioned central core layer with superior elasticity, in such a way that not only light weight, but also small reaction force in response to the bump may be obtained, sufficient for the light weight requirement for fast ships.

The shipboard-protecting fender according to the present invention is composed of a plurality of small units such that the damage may be limited locally. Moreover, this fastening structure is fixed on the perimeter of the shipboard horizontally and vertically by means of the threaded fixtures. Not only firmness and durability, but also facilitation for installation or replacement may be achieved.

DETAILED DESCRIPTION OF THE INVENTION

Figure 1A:
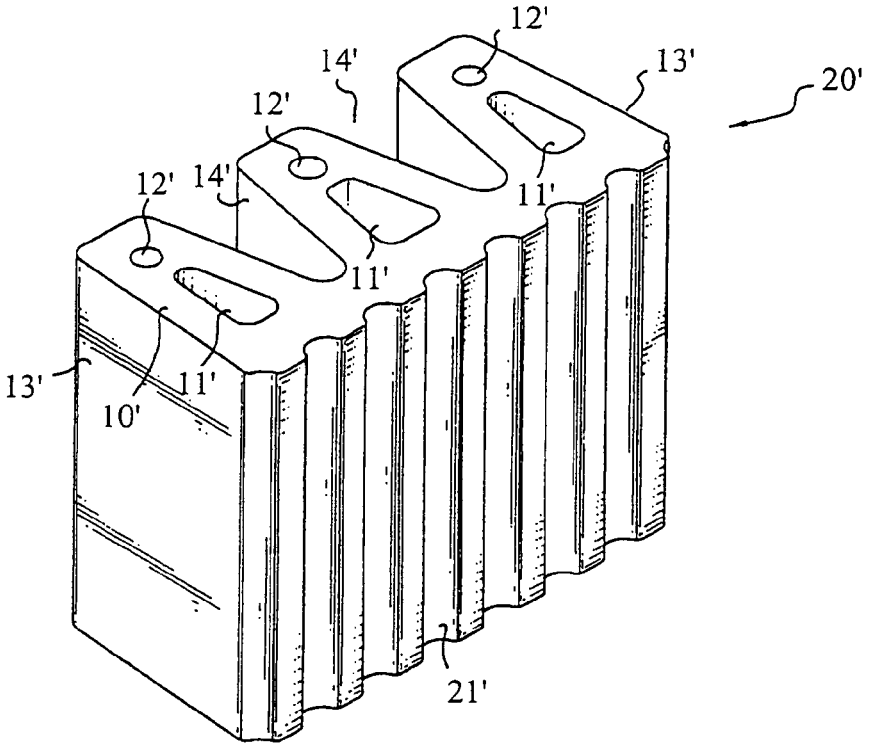
( prior art ) Fig. 1a
FIG. 1*a* is a perspective view of the conventional technology, redrawn from the Taiwan Utility Model Patent No. 389218, entitled "ASSEMBLED BUMP FENDER FOR SHIPS"
Figure 1B:
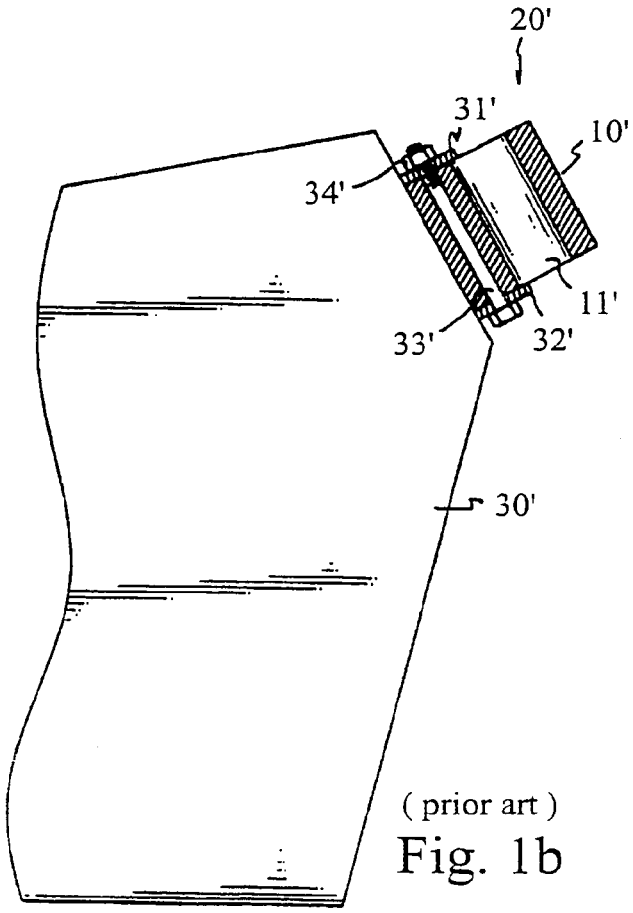
( prior art ) Fig. 1b
FIG. 1*b* is a cross section view of the one shown in FIG. 1*a* when in use.
Figure 2:
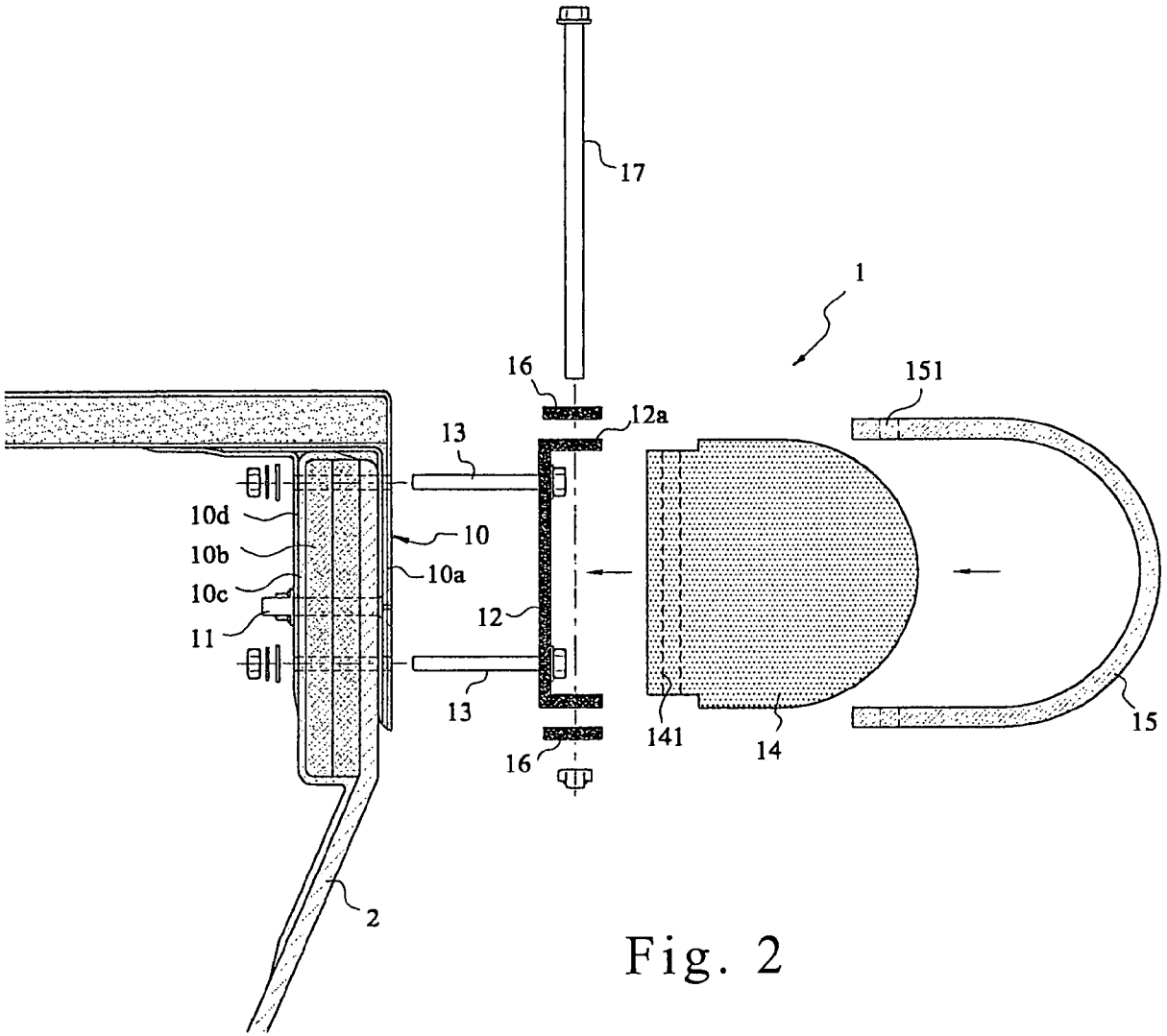
FIG. 2 is a disassembled diagram of a structure for fastening shipboard-protecting fender according to the present invention.
Figure 3:
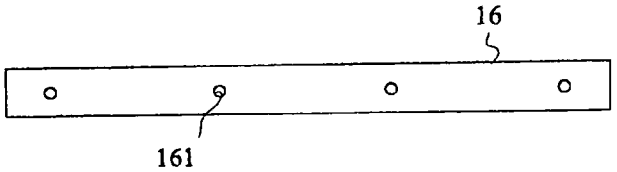
FIG. 3 is a plane diagram of a fixed plate according to the present invention.
Figure 4:
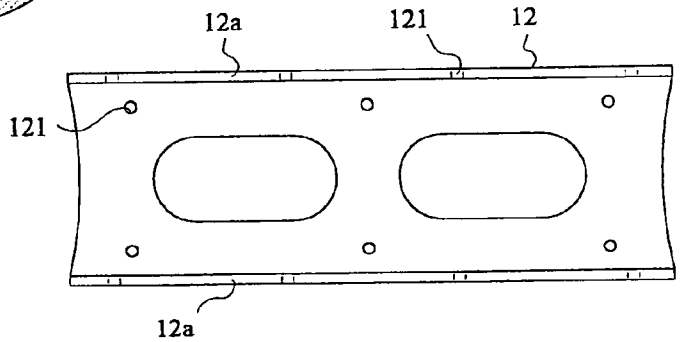
FIG. 4 is a front diagram of a fixed base according to the present invention.
Figure 5:
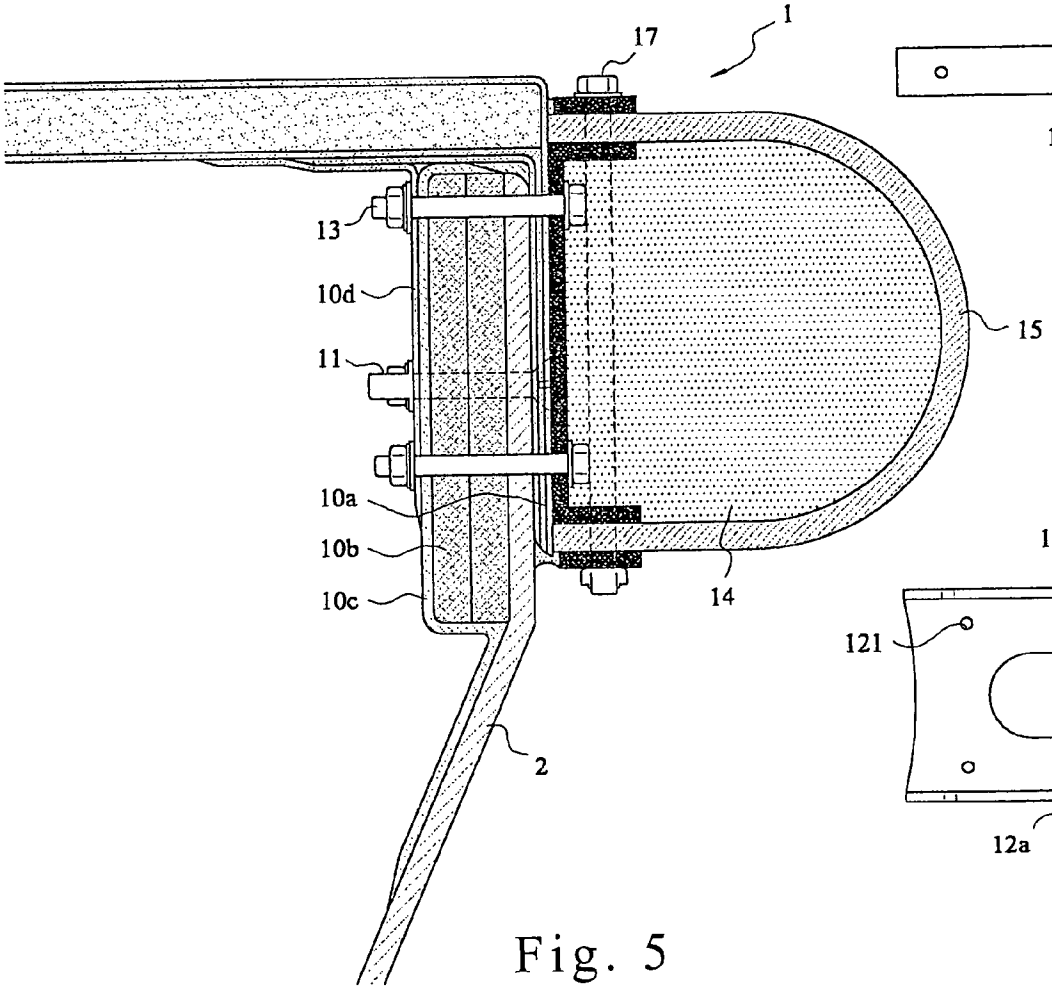
FIG. 5 is a cross section of the one shown in FIG. 2 when in use.

Firstly, referring to FIG. 2 in connection with FIGS. 3 to 5, a structure for fastening a shipboard-protecting fender 1 according to the present invention comprises a plurality of reinforcing rib layers 10 securely provided on the inner and outer faces of a shipboard 2, respectively, each reinforcing rib layer 10 including a plurality of metal sheet stacked layers 10*a* disposed on the outer face of the shipboard 2 and a plurality of wood stacked layers 10*b* disposed on the inner face of the shipboard 2. These wood stacked layers 10*b* are accommodated within an accommodating space which, constructed by a metal sheet layer 10*c*, further includes a reinforcing metal sheet layer 10*d* at the outer face thereof. The aforementioned reinforcing rib layers 10 are securely provided on the inner and outer faces of the shipboard 2 by means of a plurality of threaded fixtures 11, by welding or the like.

The structure for fastening shipboard-protecting fender according to the present invention further comprise a fixed base 12 unit including a horizontally extending portion 12*a* at the upper and lower ends thereof, respectively, for constituting an accommodating space having a cross section presented as "U"-shape. A plurality of thread holes 121 are formed on the vertical plane and the horizontally extending portion 12*a*, respectively, of the fixed base 12. Moreover, a plurality of horizontal bolts 13 are used with these thread holes to threadedly fastening the vertical plane of the fixed base 12 unit onto the outer face of the reinforcing rib layer 10 of the shipboard 2.

Additionally, a core layer 14 is provided, one end of which is accommodated in the accommodating space of the fixed base, and formed with a plurality of vertical through-holes 141 in correspondence with the thread holes 121 on the extending portion 12*a*, while the other end thereof is formed as a surface of half-circle. A bump-protecting layer 15 having a structure with a "U"-shaped cross section, covering over the outer face of the core layer 14 and the extending portion 12*a* of the fixed base to construct the shipboard-protecting fender 1 having a surface of half-circle, may be further provided. The pump-protecting layer 15 is formed, at two ends thereof, with a plurality of thread holes 151 in correspondence with the thread holes 121 on the extending portion 12*a* of the fixed base 12. Moreover, a pair of fixed plates 16 may be included. These two fixed plates are supported on the outer face at two ends of the bump-protecting layer 15, respectively; while formed with a plurality of thread holes 161, correspondingly. A plurality of vertical bolts 17 are provided through these fixed plates 16, the bump-protecting layer 15, the extending portion 12*a* of the fixed base 12, and the core layer 14, in order to fasten them.

In accordance with the present invention, the bump-protecting layer 15 on the surface of the shipboard-protecting fender 1 is made from polyurethane material having superior wear resistance; while the central core layer 14 is the close cell of ethylene-vinylacetate copolymer material physically featuring non-water absorbability, light weight, and superior elasticity. Not only superior impact resistance and stress damage-resistance, but also excellent weather resistance, impermeability for water, and corrosion resistance may be found in the ideal combination of these two materials. Additionally, the surface bump-preventing layer 15 with wear resistance is filled with the aforementioned central core layer 14 with superior elasticity, in such a way that not only light weight, but also small reaction force in response to the bump may be obtained, sufficient for the light weight requirement for fast ships.

The shipboard-protecting fender 1 according to the present invention is composed of a plurality of small units such that the damage may be limited locally. Moreover, the shipboard-protecting fender 1 is securely locked on the reinforcing rib layer 10, which provides a strong support, around the perimeter of the shipboard by mean of the horizontal bolts 13 and the vertical bolts 17. Not only firmness and durability, but also facilitation for installation or replacement may be achieved.

The foregoing description is merely one embodiment of present invention and not considered as restrictive. Namely, all equivalent variations and modifications without in any way departing from the ambit of the invention should be intended to be within the scope of the present invention.

To sum up, the structure for fastening shipboard-protecting fender of the present invention may provide moderate toughness and stiffness, as well as superior impact resistance. This structure is firm and durable, being truly an invention with novelty, advancement or non-obviousness, and availability by the industry.

LIST OF REFERENCE NUMBERALS

1 shipboard-protecting fender of the present invention
10 reinforcing rib layer
10*a* metal sheet stacked layer
10*b* wood stacked layer
10*c* metal sheet layer
10*d* metal sheet layer
11 threaded fixture
12 fixed base
12*a* extending portion
121, 151, 161 thread hole
13, 17 bolt
14 core layer
141 through-hole
15 bump-protecting layer
16 fixed plate
2 shipboard-protecting fender

The invention claimed is:

1. A structure for fastening a shipboard-protecting fender, comprising:

a plurality of reinforcing rib layers securely provided on the inner and outer faces of a shipboard;

a fixed base horizontally fastened on said reinforcing rib layers of said shipboard by means of a plurality of bolts, an accommodating space being formed at the outside of said fixed base;

a core layer, one end of which is accommodated in said accommodating space of said fixed base;

a bump-preventing layer covering the outer surface of said core layer and said fixed base;

a pair of fixed plates supported at the outside of the two ends of said bump-preventing layer; and a plurality of bolts vertically passing through said fixed plates, said bump-preventing layer, said fixed base, and said core layer for fastening them.

2. The structure for fastening shipboard-protecting fender according to claim 1, wherein said shipboard-protecting fender is composed of a plurality of small units.

3. The structure for fastening shipboard-protecting fender according to claim 1, wherein said bump-preventing layer is made from polyurethane material.

4. The structure for fastening shipboard-protecting fender according to claim 3, wherein the cross section of said bump-preventing layer is formed as a U-shaped structure.

5. The structure for fastening shipboard-protecting fender according to claim 1, wherein said core layer is the close cell of ethylene-vinylacetate copolymer material.

6. The structure for fastening shipboard-protecting fender according to claim 1, wherein said reinforcing rib layers are wood stacked layers.

7. The structure for fastening shipboard-protecting fender according to claim 6, wherein said shipboard is formed with an accommodating space inside thereof by means of metal sheets for accommodating said wood stacked layers.

8. The structure for fastening shipboard-protecting fender according to claim 1, wherein said reinforcing rib layers are metal sheet stacked layers.

9. The structure for fastening shipboard-protecting fender according to claim 1, wherein said fixed base includes a horizontal extending portion at the lower end thereof, such that said base is formed as a U-shaped structure.

10. The structure for fastening shipboard-protecting fender according to claim 1, wherein the outer surface of said core layer is formed as a half-circle.

* * * * *